US006871599B2

(12) United States Patent
Okuno et al.

(10) Patent No.: US 6,871,599 B2
(45) Date of Patent: Mar. 29, 2005

(54) RAILWAY CAR

(75) Inventors: Sumio Okuno, Kudamatsu (JP); Kazufumi Yamaji, Yamaguchi (JP); Kentaro Masai, Kudamatsu (JP)

(73) Assignee: Hitachi, Ltd., Tokyo (JP)

( * ) Notice: Subject to any disclaimer, the term of this patent is extended or adjusted under 35 U.S.C. 154(b) by 16 days.

(21) Appl. No.: 10/083,545

(22) Filed: Feb. 27, 2002

(65) Prior Publication Data

US 2002/0157564 A1 Oct. 31, 2002

(30) Foreign Application Priority Data

Apr. 25, 2001 (JP) ..... 2001-126866

(51) Int. Cl.[7] ..... B61D 17/00

(52) U.S. Cl. ..... 105/396; 105/238.1; 105/404; 296/181

(58) Field of Search ..... 105/238.1, 361, 105/396, 404, 412, 413, 423, 452, 454, 463.1, 392.5, 393, 402, 410; 280/784; 296/181, 189; 293/133, 136; 188/377

(56) References Cited

U.S. PATENT DOCUMENTS

| | | | | |
|---|---|---|---|---|
| 1,080,024 A | * | 12/1913 | Stevens et al. | 105/402 |
| 3,831,997 A | * | 8/1974 | Myers | 296/189 |
| 3,888,502 A | * | 6/1975 | Felzer et al. | 280/784 |
| 3,983,962 A | * | 10/1976 | Torke | 188/377 |
| 4,154,469 A | | 5/1979 | Goupy et al. | |
| 4,235,170 A | * | 11/1980 | Bauer | 105/402 |
| 4,715,292 A | * | 12/1987 | Pavlick et al. | 105/456 |
| 5,429,388 A | * | 7/1995 | Wheatley et al. | 280/784 |
| 6,196,135 B1 | * | 3/2001 | Kashima et al. | 105/392.5 |
| 6,263,805 B1 | * | 7/2001 | Taguchi et al. | 105/421 |
| 6,312,028 B1 | * | 11/2001 | Wilkosz | 293/133 |
| 6,312,038 B1 | * | 11/2001 | Kawamura et al. | 296/68.1 |
| 6,394,000 B1 | * | 5/2002 | Kawasaki et al. | 105/401 |

FOREIGN PATENT DOCUMENTS

| | | |
|---|---|---|
| DE | 19833935 | 2/1999 |
| DE | 19904879 | 8/2000 |
| EP | 1006034 | 6/2000 |

* cited by examiner

*Primary Examiner*—Frantz F. Jules
(74) *Attorney, Agent, or Firm*—Antonelli, Terry, Stout & Kraus, LLP

(57) ABSTRACT

In a railway car body formed of hollow shape members 40, a hollow shape member 51 having a shock absorbing function is provided to the ends of a hollow shape member 40 constituting an underframe 30, where impact load is most likely to be received. The hollow shape member 40 is positioned so that the longitudinal direction thereof is arranged along the longitudinal direction of the car body. When impact load is received, the hollow shape member 51 formed at the ends of the member 40 deforms and collapses, thereby relieving the impact force. The present invention simply provides treatment to some areas of the hollow shape members that form the car body without changing the conventional railway car structure greatly, thus minimizing the impact load provided to the passengers upon collision, and improves the safety of the railway car.

11 Claims, 12 Drawing Sheets

RAILWAY CAR

FIELD OF THE INVENTION

The present invention relates to a body of a railway car that travels on rails, and is especially preferable for forming a railway car body composed of hollow shape members made of light alloy.

DESCRIPTION OF THE RELATED ART

In forming a railway car, consideration must be made on absorbing and relieving the impact force loaded to the passengers on board in case collision occurs. Japanese Patent Laid-Open Publication Nos. H11-301476 and 6-211133 disclose a car formation comprising plural car bodies being connected linearly, wherein a shock absorbing mechanism such as an easily breakable structure is equipped to the underframe at the front end of the leading car body, thereby absorbing the shock of collision and relieving the impact to the passengers on board.

Japanese Utility Model Publication No. 57-56929 discloses a coupler disposed on the end portion of an underframe of a car body for connecting the car body to an adjacent car body. Therefore, a strengthening member is provided to the lower surface of the underframe at the end portion so as to realize a strong structure.

As disclosed in Japanese Patent Laid-Open Publication No. 2-246863, the car body is formed of hollow shape members made of light alloy material. Each hollow shape member is disposed so that the direction of extrusion thereof is arranged along the longitudinal direction of the car body.

The railway car is formed by coupling plural car bodies together (this is called a car formation), so when considering ways to cope with collision, the collision between car bodies arranged adjacent to one another in the car formation must also be considered. The underframe constituting the floor of the car is formed strongly.

When collision occurs at the leading car, the car bodies constituting the car formation collide against each other, or in other words, the underframes of the car bodies collide against each other. However, even if the underframes collide against each other, the underframes will not collapse by the collision since they are built firmly, thus the impact of collision is not relieved.

Further, it is desirable to provide a shock absorbing mechanism not only to the leading car body of the car formation but also to each of the car bodies constituting the car formation. The position on which the shock absorber is disposed should be the end of each car body. However, the following problems occur when such assembly is employed.

(1) The shock absorbing mechanism cannot be equipped to a car structure in which the end of the car body to which the shock absorber is to be disposed is short in length and the interior of the car body or the space under the floor of the car body is narrow and restricted.

(2) When the underframe is formed only by plural hollow shape members disposed along the longitudinal direction of the car body, the strength of the underframe is advantageously secured since the hollow shape members have high in-plane rigidity and high outer-surface flexural rigidity, but such structure is disadvantageous from the point of view of absorbing and relieving the impact force.

(3) The ends of the car body are built firmly, and it is very difficult to assemble the shock absorbing mechanism to such areas of the car body.

SUMMARY OF THE INVENTION

The object of the present invention is to provide a highly safe car body equipped with a shock absorbing mechanism.

The above-mentioned object of the present invention is achieved by providing an underframe characterized in that the material constituting both longitudinal ends of the underframe is softer than the material constituting the longitudinal center area of the underframe.

The second method achieves the object of the present invention by providing a car formation comprising plural car bodies being coupled together, wherein both ends of each car body of said car formation constituting a portion of a passenger room is equipped with a member that shrinks in the longitudinal direction along the car body when the car body collides against an adjacent car body.

DETAILED DESCRIPTION OF THE PREFERRED EMBODIMENT

Figure 1:
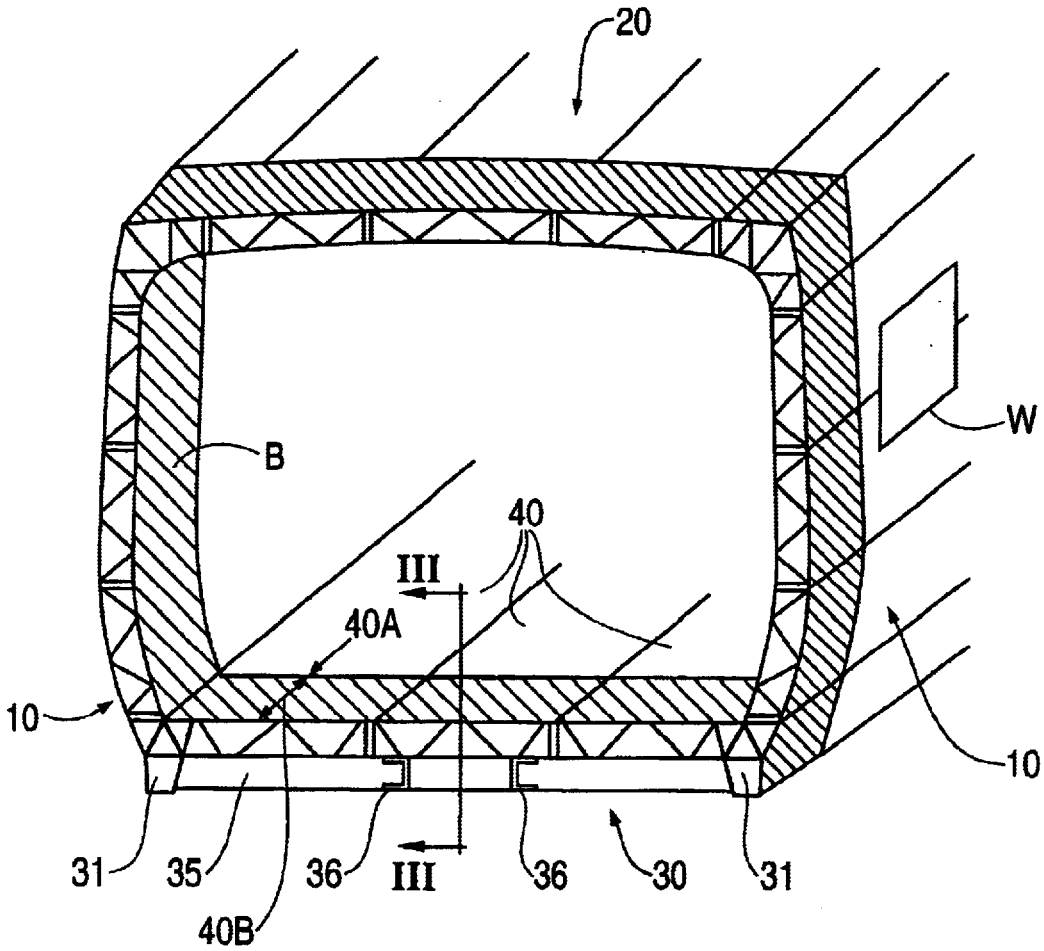
FIG. 1 is a perspective view showing the end portion of a railway car body according to one embodiment of the present invention.
Figure 2:
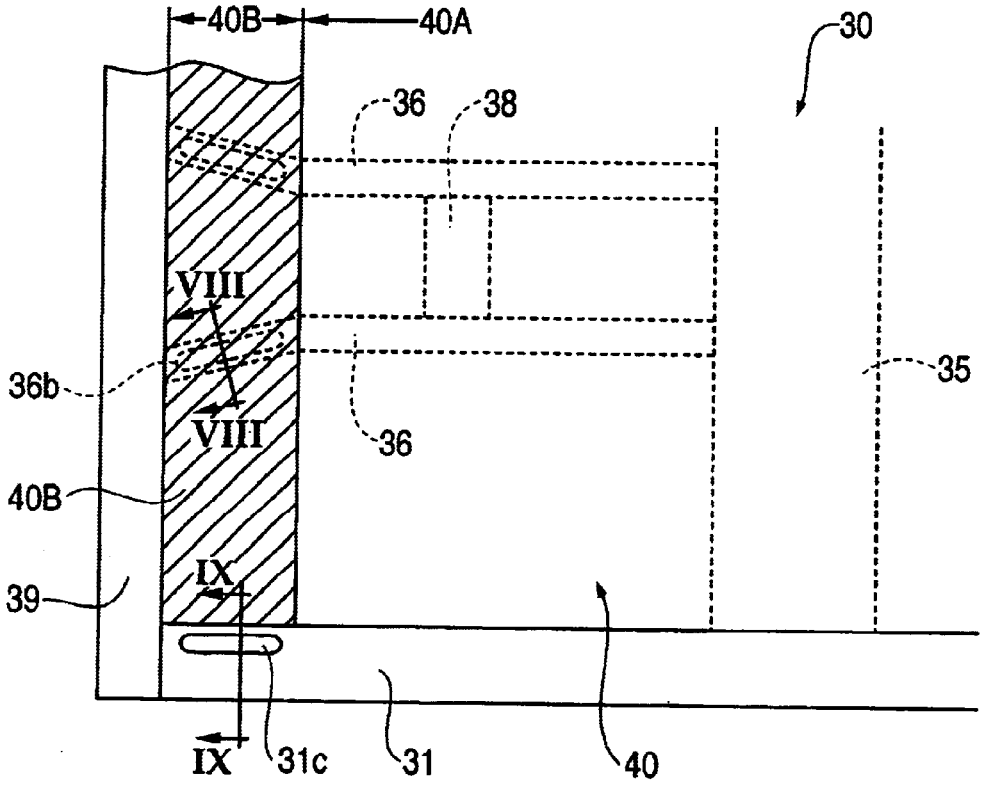
FIG. 2 is a plan view showing the underframe at the end portion of the car body of FIG. 1.
Figure 3:
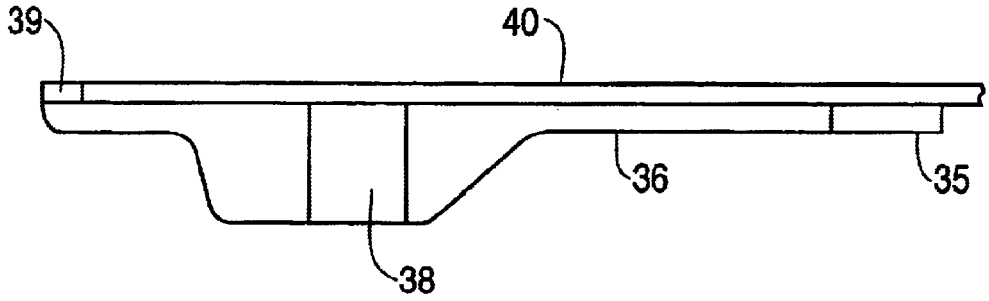
FIG. 3 is a III—III cross-sectional view of FIG. 1.

A preferred embodiment of the present invention will now be explained with reference to FIGS. 1 through 9. In FIG. 2, no hollow shape member 40 is shown. However, members 35, 36 and 38 disposed below plural hollow shape members 40 are shown by dotted lines on the assumption that the plural hollow shape members 40 are disposed thereto.

The car body comprises side structures 10 that constitute the sidewalls of the car body, the roof structure 20, an underframe 30 that constitutes the floor thereof, and so on. The side structures 10, the roof structure 20, and the underframe 30 are all formed by welding plural hollow shape members together. Each hollow shape member is an extruded shape member made of light alloy, and the direction of extrusion (that is, the longitudinal direction) is arranged in the longitudinal direction of the car body. Plural hollow shape members are arranged along the circumferential direction of the car body having the width direction ends of each member disposed adjacent to one another, and the members are welded to form a single integrated structure. Reference W denotes a window. The present car body is supported by two bogies. One car body is connected to an adjacent car body via a coupler.

The underframe 30 comprises a floor portion, side sills 31 disposed on both sides thereof, and a coupling member for connecting the coupler. The floor portion is formed of plural hollow shape members 40 each having its direction of extrusion disposed along the longitudinal direction of the car body. Side sills 31 formed of hollow shape members are disposed on both width-direction-sides of the underframe. Each side sill 31 is large in size with a greater plate thickness, and is firmly built.

Moreover, a coupling member for connecting a coupler used to connect the car bodies together is disposed on the lower surface of both longitudinal ends of the underframe. The coupling member is composed of a bolster 35 arranged along the width direction of the car body, two center sills 36, 36 extending from the bolster 35 to the end of the car body, and an end beam 39 disposed at the end of the center sills 36, 36. The two center sills 36, 36 are connected by a member 38. The center sills 36, 36 are positioned near the width-direction-center of the car body. A coupler for connecting the car bodies together is disposed between the two center sills 36, 36. Since the coupler is connected closer to the end than the member 38, the height of the center sills at such end area is higher than the other areas. The above-mentioned members are joined together by welding. Both ends of the bolster 35 are welded onto the side sills 31, 31. The end beam 39 is welded onto the ends of plural hollow shape members 40, and both ends of the end beam 39 are welded The hollow shape members (shown by the shaded portion of FIGS. 1 and 2) 40B disposed at both longitudinal ends of the pair of side structures 10, the roof structure 20 and the underframe 30 constituting the car body are formed to have a different mechanical property from the hollow shape members 40A constituting the center portion of the car body. The hollow shape members 40B are formed of a material softer than the material of the hollow shape members 40A, and the hollow shape members 40B collapse easily when collision occurs, realizing a shock absorbing mechanism. The cross-sectional shapes of the hollow shape members 40A and 40B are the same. The ends of the car body on which the hollow shape members B are equipped constitute the passenger room (including the bathroom, the lavatory, the crew's room, etc.).

The center sills 36 and the side sills 31 within the area of the end of the car body where the hollow shape members 40B are equipped are also formed to collapse easily by impact force, similar to the hollow shape members 40B. The upper plate and the side plates of the center sills 36 within range 40B are provided with long holes 36*b*. Each center sill 36 has a channel-like cross-sectional shape with no bottom plate. Each side sill 31 within range 40B provided with long holes 31*b*, 31*c*, 31*d*, 31*e*, 31*f* formed to the face plates (face plates facing the inner side of the car body) excluding the side face plate facing the exterior of the car body. The reason for not providing the long hole to the exterior-side face plate is to prevent deterioration of appearance. Further, a thin plate (not shown) is welded to the long holes 31*e* and 31*f* exposed to the exterior of the car body to shut the opening of the long holes. This Is to prevent water from intruding the inner side of the side sills.

The hollow shape members constituting the side structures 10 the roof structure 20, and the underframe 30 of the car body comprise hollow shape members 40B, 40B disposed at both longitudinal end portions, and hollow shape members constituting the other areas (the center area). The length of the hollow shape member 40B can be, for example, about 100 to 500 mm. The hollow shape member 40B is softer than the hollow shape member 40A. The hollow shape member 40B is softened by annealing.

This annealing can be, for example, an O-material treatment (0: temper of annealed metal). In general, various heat treatments are provided to the extruded shape member after the extrusion. If the material of the extruded shape member is A6N01, an artificial aging and hardening process of T5 is performed. The annealing of the O-material is performed thereafter. The annealing treatment to the O-material is performed for two hours at 380° C., and the strength is 36.8 MPa. T5 has a strength of 245 MPa. The annealing of the O-material is meant to soften the hollow shape member. The elongation of the hollow shape member 40B is greater than that of the hollow shape member 40A. The strength of the hollow shape member 40B is smaller than that of the hollow shape member 40A. In order to provide necessary strength and softness to the member, annealing other than the O-material treatment can also be performed.

Figure 4:
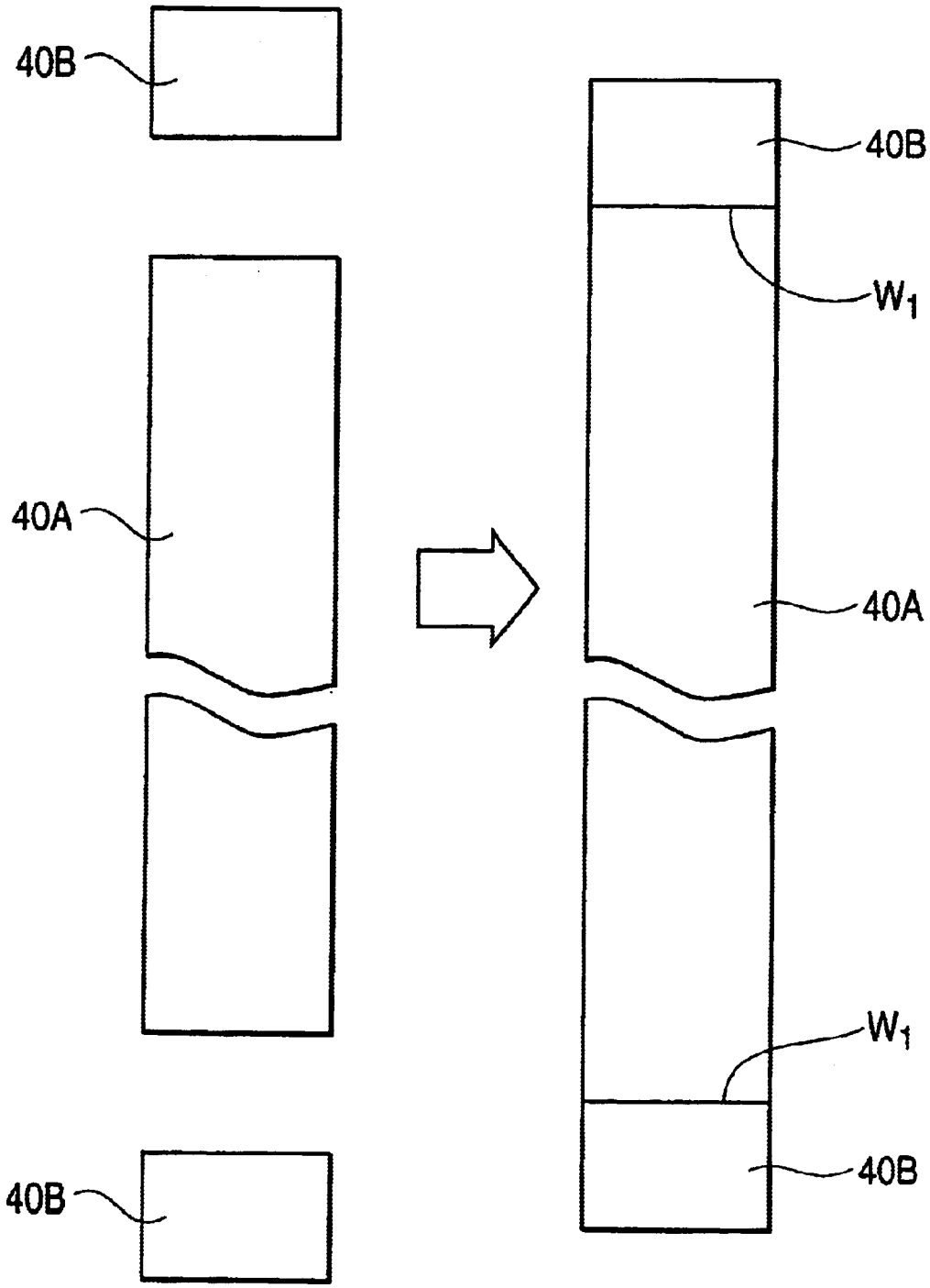
FIG. 4 is an explanatory view showing the method of manufacturing the hollow shape member according to one embodiment of the present invention.

The above-mentioned heat treatment can be performed after cutting the hollow shape member 40B to the desired length as shown in FIG. 4, or can be performed while the hollow shape member is still long (not cut). When the hollow shape member is long, the member is cut to the predetermined length (40B, 40B) after the heat treatment.

Figure 5:
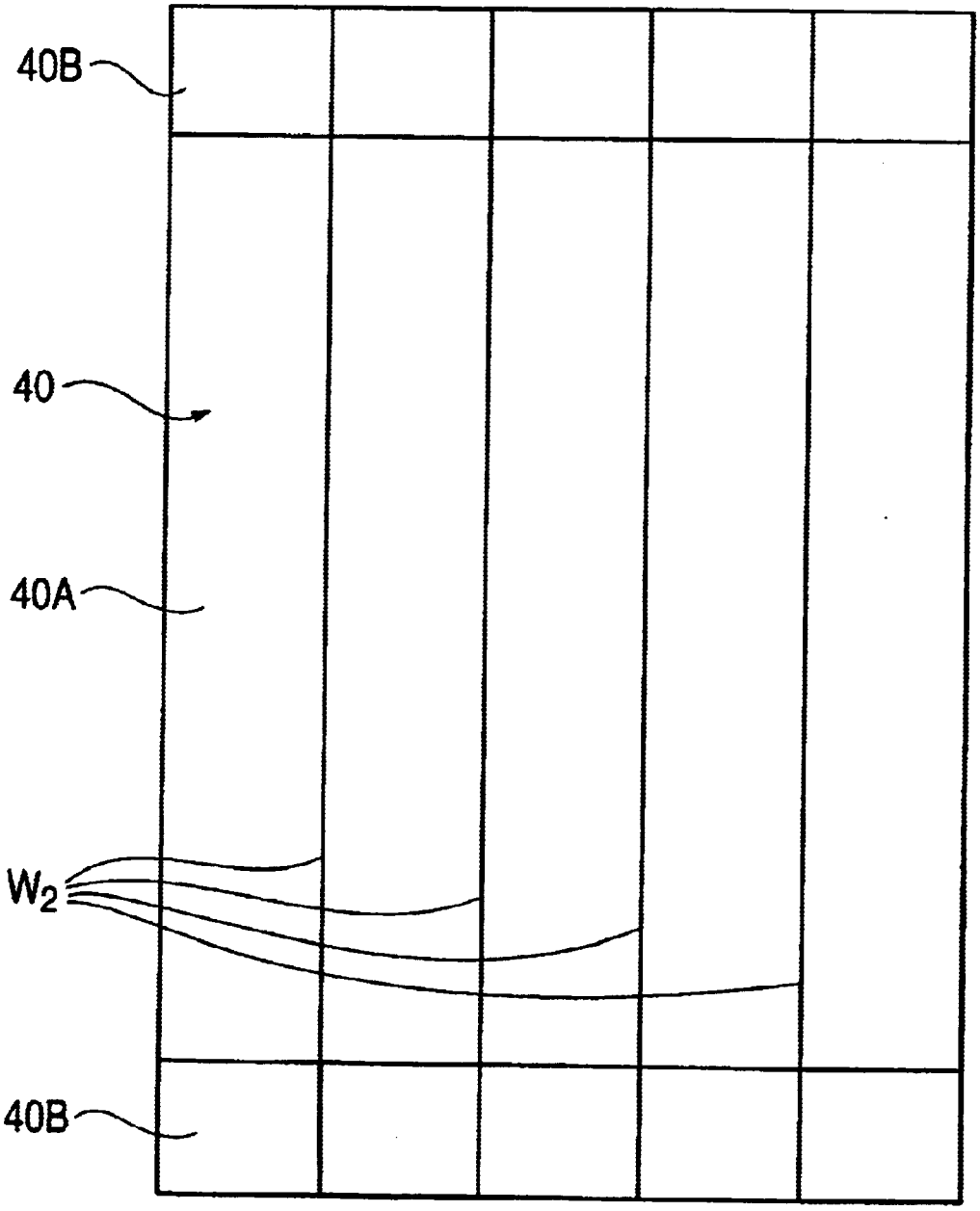
FIG. 5 is a plan view showing the whole structure of the underframe.

The hollow shape member 40A and hollow shape members 40B, 40B treated as explained above are welded together by welding $W_1$, to form a hollow shape member 40 having a length corresponding to the total length of the car body. The hollow shape members 40 manufactured accordingly are arranged side-by-side in the width direction (circumferential direction of the car body) as shown in FIG. 5, and they are welded together in the conventional way by welding $W_2$, thus forming the underframe 30, the side structures 10 and the roof structure 20. When forming the underframe 30, connecting members such as the side sills 31, 31 and the center sill 36 etc. are welded. The number of hollow shape members 40 appearing in FIG. 1 is different from the number of hollow shape members 40 in FIG. 5, since the number of members 40 in FIG. 1 is reduced so as to simplify the drawing.

Figure 6:
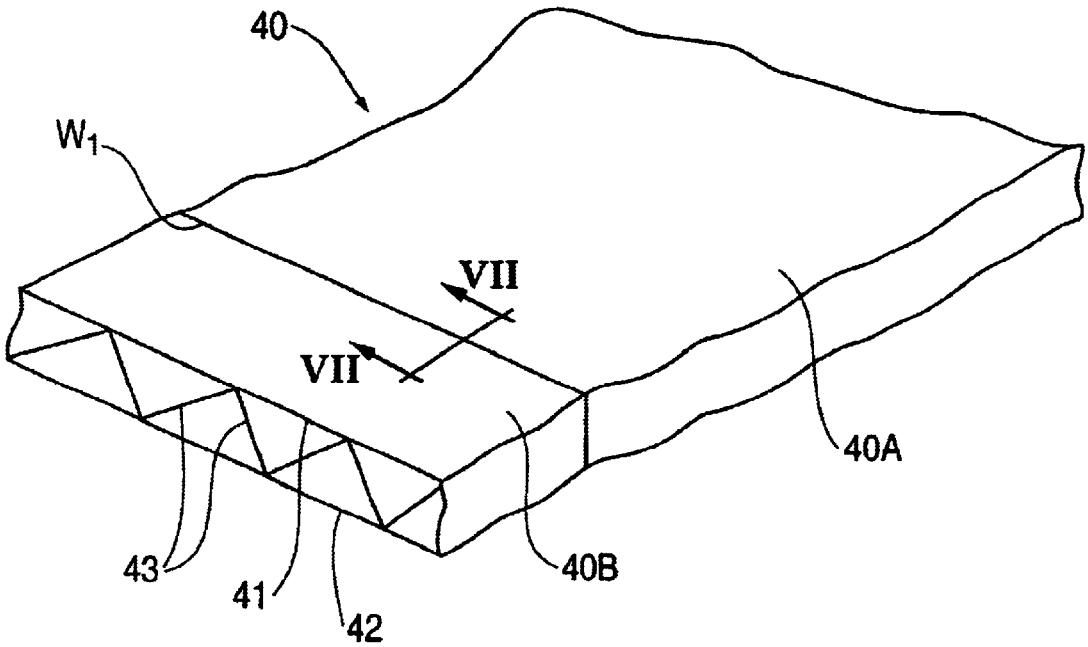
FIG. 6 is a perspective view showing the end portion of the underframe of FIG. 1.
Figure 7:
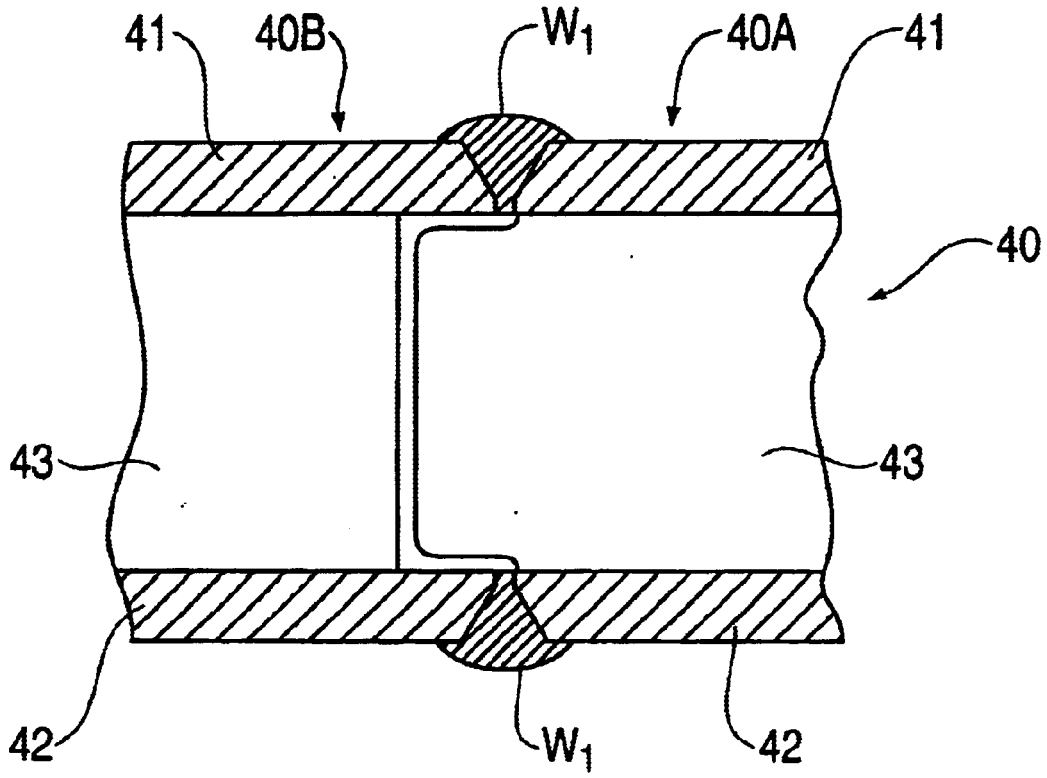
FIG. 7 is a VII—VII cross-sectional view of FIG. 6.
Figure 8:
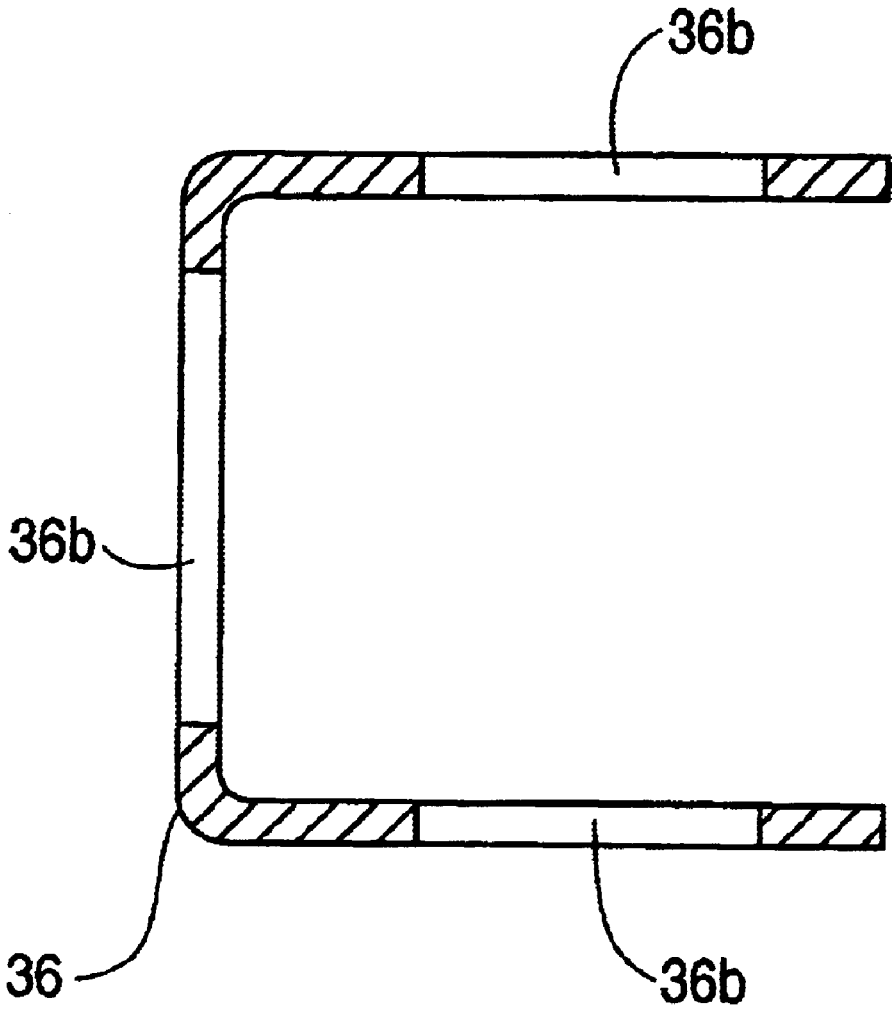
FIG. 8 is a VIII—VIII cross-sectional view of FIG. 2.
Figure 9:
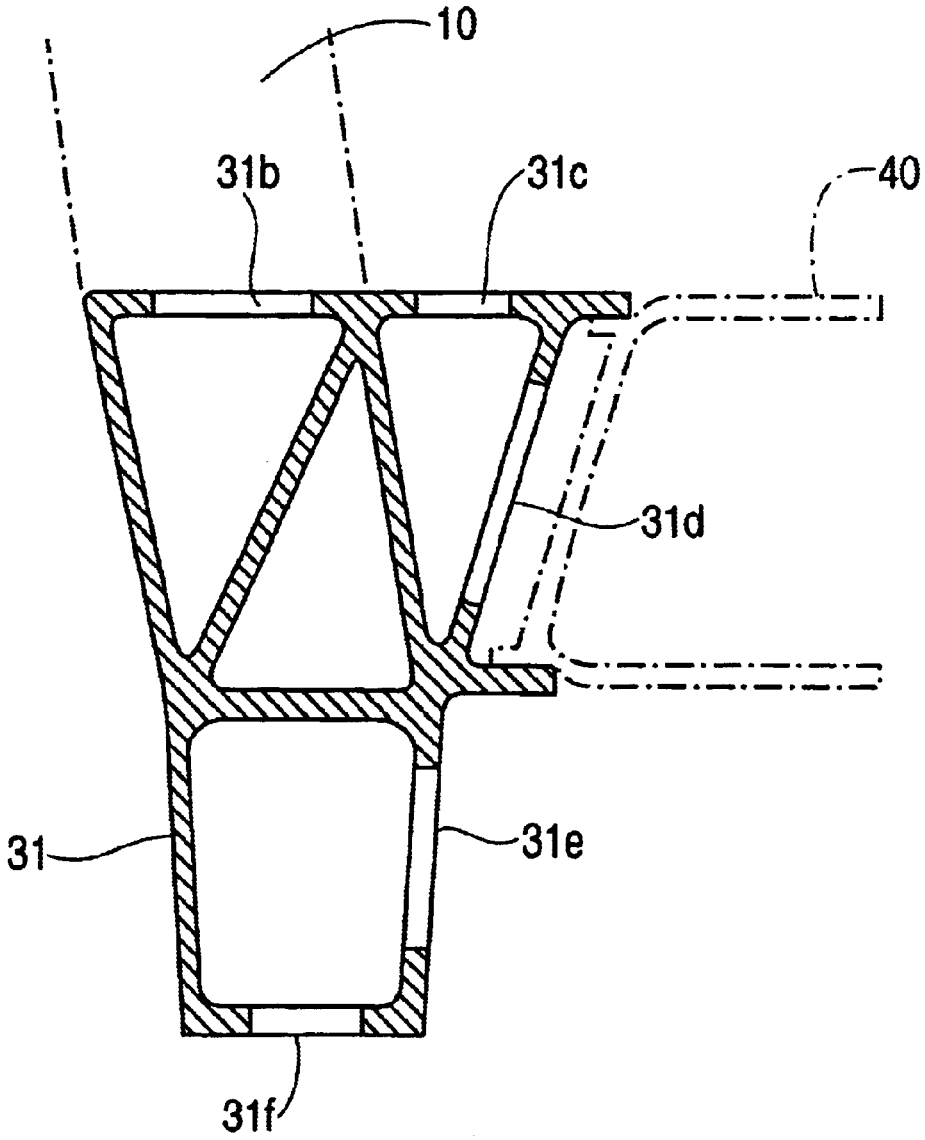
FIG. 9 is a IX—IX cross-sectional view of FIG. 2.

The welding between hollow shape members 40B and hollow shape member 40A is explained with reference to FIGS. 6 and 7. As known widely, the hollow shape member 40(40A, 40B) comprises two face plates 41 and 42, and connecting plates 43 for connecting the face plates 41, 42. The connecting plates 43 are slanted, and the slanted plates 43, 43 are arranged in trusses. In some cases, at the end portion where one hollow shape member 40 is welded onto another hollow shape member 40, the plate connecting the two face plates 41, 42 is not slanted but is orthogonal to the face plates 41, 42.

The ends of hollow shape members 40A and 40B can fit into one another. At the longitudinal ends of the hollow shape member 40A, the face plates 41 and 42 are removed by a cutting process so that the plural slanted members (connecting plates) 43 protrude therefrom. On the other hand, the hollow shape member 40B is formed so that plural slanted members 43 are removed at the end region. The slanted members 43 protruding from the end of the hollow shape member 40A can be inserted to the space between the two face plates 41, 42 of the hollow shape member 40B. After the members 40A and 40B are fit into one another, the face plates 41 and 41(42 and 42) are welded together from the outer side. Since the members are fit into one another before the welding, the occurrence of bend or bump at the joint is suppressed, and the welding procedure can be performed with ease.

Figure 10:
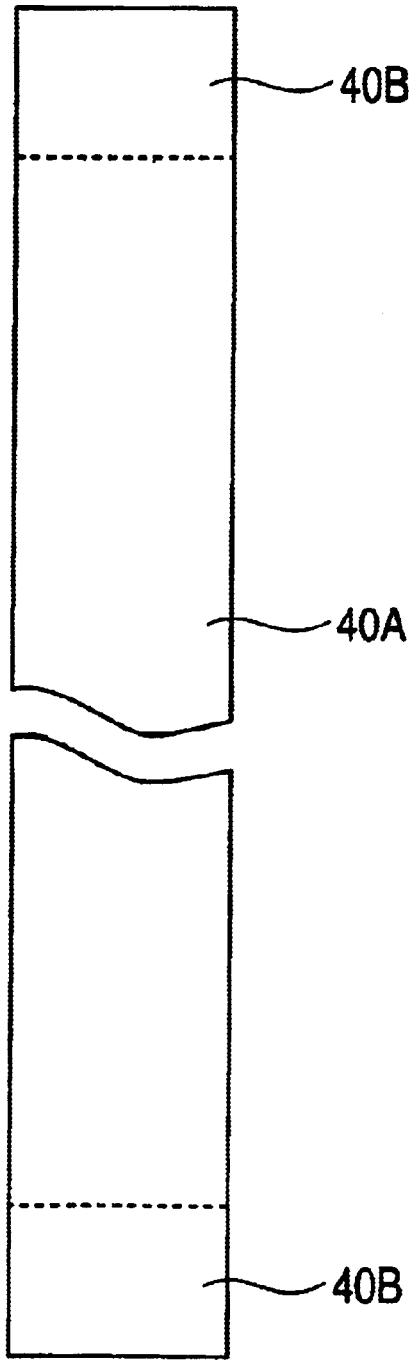
FIG. 10 is an explanatory view showing the method of manufacturing the hollow shape member according to another embodiment of the present invention.

Next, another method of manufacturing the car body is explained with reference to FIG. 10. A hollow shape member having a length corresponding to the whole length of the car body is used, without separating the length of the member into plural parts. The two end areas in the long hollow shape member are heat-treated (annealed) as it is to create portions 40B having predetermined lengths. Possible methods for this heat treatment can include a method for partially heating the long hollow shape member inside a heating furnace, or a method performing high frequency hardening and the like where the hollow shape member is partially heated to obtain the desired property. After forming the hollow shape member having a length corresponding to the total length of the car body as mentioned above, the plurality of members are welded together to form the underframe.

When the car body collides against an obstacle, the coupler connecting one car body with another body drops by the impact. Therefore, the end portion of one car body collides against the end portion of the adjacent car body. First, the end beam 39 disposed at the end of one car body collides against the end beam 39 of the adjacent car body. This provides impact to the plurality of hollow shape members 40, the side sills 31, and the center sills 36. Further, impact force acts on the ends of the side structures 10 and the roof structure 20.

Since the end portion of the car body is constituted of hollow shape members 40B formed softer than the hollow shape members 40A disposed at the center area of the car body, when impact occurs, the hollow shape members 40B deform faster than the other portions constituted by hollow shape members 40A of the underframe, relieving the shock of the impact. Since the center sills 36 and the side sills within the range of hollow shape member 40B are provided with holes to help ease deformation, the sills deform similarly when impact occurs, allowing the hollow shape members 40B of the underframe 30 to deform. Moreover, the side structures 10, 10 and the roof structure 20 deform similarly as the underframe 30 since the end portions thereof are formed with soft hollow shape members 40B.

The soft hollow shape members 40B are disposed at the ends of the car body. This end position is defined as the area between the end beam 39 and the portion where the center sills 36 gain height (the portion near member 38 for the coupler). This area is thus determined considering the influence to the passengers and crew within the car body. Since lavatories and equipment exist at the ends of the car body, and since the end portion takes up very little of the whole car body, influence to the passengers is relatively small. Moreover, the above-mentioned end range is determined so that if the car-end compressive load acting normally on the car body is applied, only small burden share is provided to this end range, and it will not influence the strength of the whole car body greatly. The length of each hollow shape member 40B is within the range of about 100 to 500 mm, and falls within the above-mentioned range.

Figure 11:
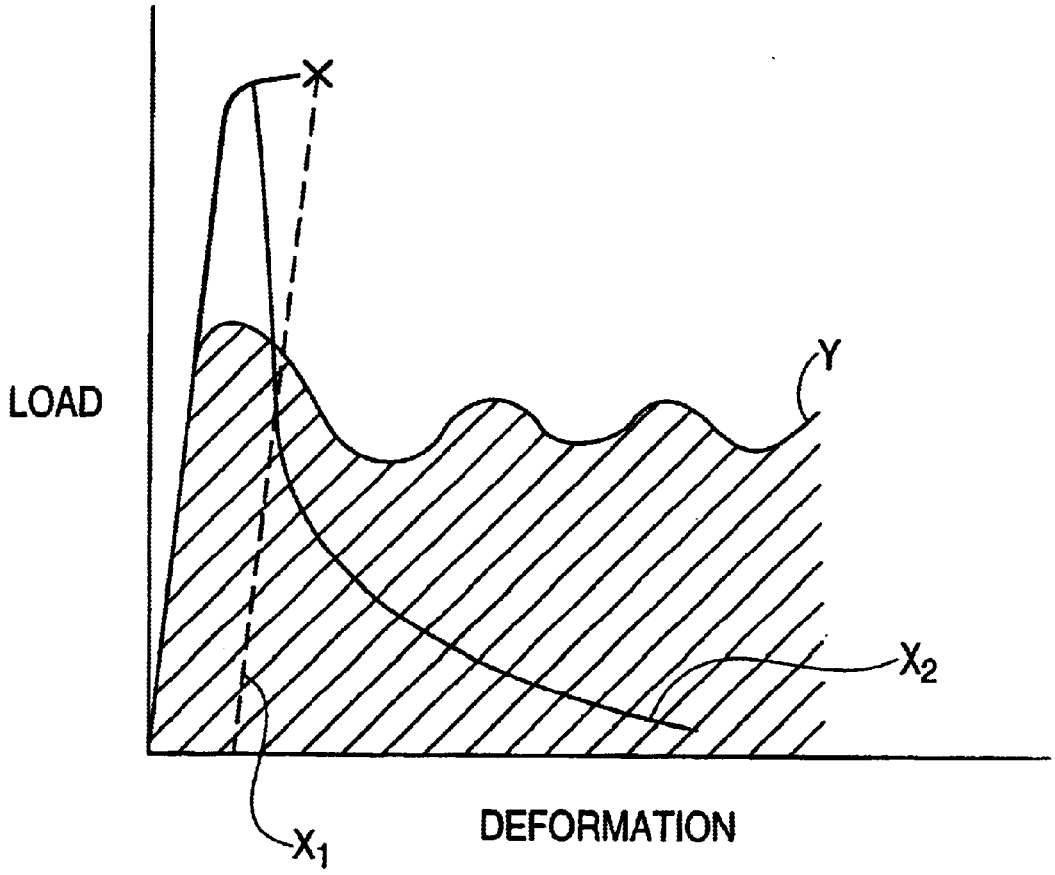
FIG. 11 is an explanatory view of the collision energy of various materials.
Figure 12:
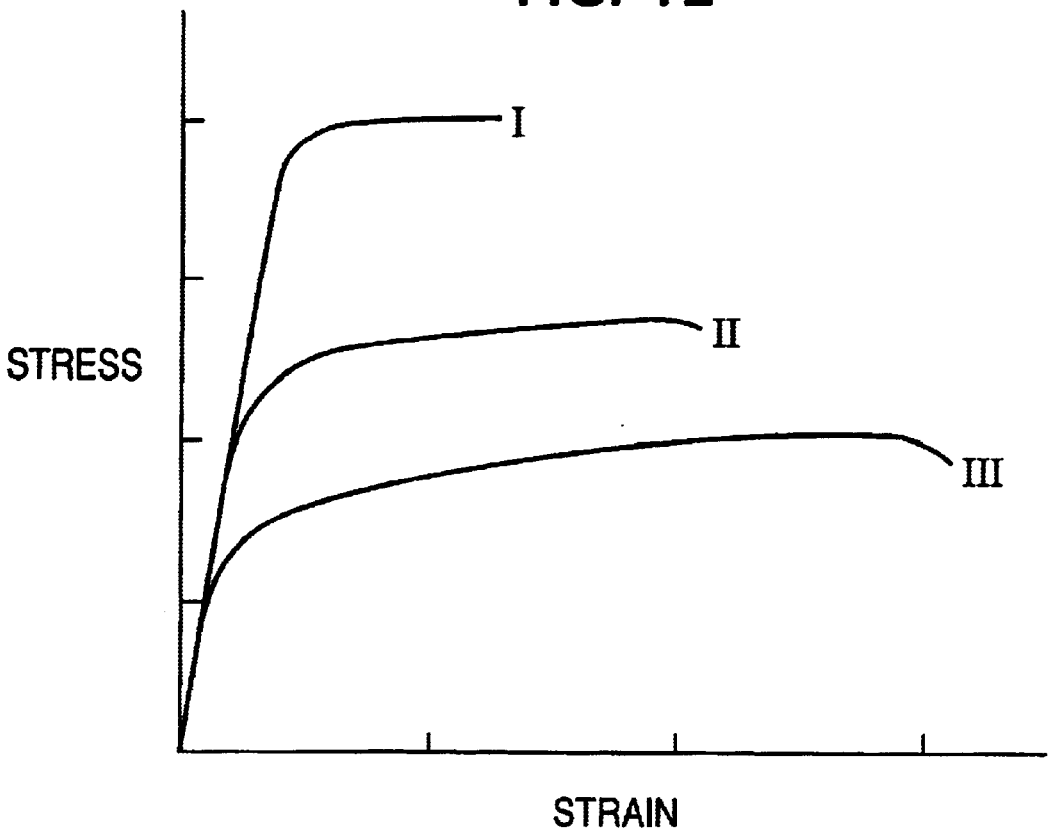
FIG. 12 is a stress-strain diagram of the materials.

The shock absorbing property of the hollow shape member 40B will now be explained. Normally, when compressive load is applied to a conventional material used for railway cars, the material shows a load-deformation behavior as shown in FIG. 11. Three possible types of material characteristics are considered as shown in FIG. 12, a material I having high strength (such as pull strength, yield strength) but small elongation (brittle), a material III having less strength but better elongation, and a material II having a property intermediate those of materials I and III; The material shown by the curve X ($X_1$, $X_2$) of FIG. 11 (the material corresponding to strength property I of FIG. 12) has better withstand load, but the withstand load drops rapidly after the value exceeds the maximum load. On the other hand, when the material has low strength and high elongation (the material corresponding to strength property III of FIG. 12), the maximum withstand load is smaller but the withstand load does not drop rapidly after the maximum value, as shown by the curved line Y of FIG. 11.

The shaded area corresponding to curved line Y indicates the breaking energy of this material. When comparing the X curve with the Y curve, the material having less strength but better elongation (in this case, the material shown by curved line Y) has higher breaking energy according to the deformation behavior after exceeding the maximum withstand load. It is important to select as shock absorbing member B a material having such strength characteristic Y. A material having the Y-curve property can be obtained easily by providing, for example, an O-material treatment to an extruded member.

In the case of curved line X, since the material has high strength and small elongation, the elongation of the member cannot correspond to the imbalance of the stress within the cross-section of the member, causing partial breaking thereof, and reducing the withstand load rapidly. On the other hand, in the case of the curved line Y, the maximum withstand load of the member is lower than the material of the curve X, but since the elongation of the material is greater, plastic deformation of the material (elongation of the member) occurs partially corresponding to the scattered stress within the cross-section of the material, preventing the withstand load from dropping rapidly. Accordingly, the material is allowed to deform greatly while maintaining a certain level of withstand load.

When such material is used, the hollow shape member 40B deforms and collapses before the other portions 40A of the hollow shape members, relieving the impact loaded to the car body. Moreover, since the member 40B is made of a hollow shape member, in comparison to the general thin-plate structure, the member has higher inner-plate and outer-plate flexural rigidity, and since it has a composite structure including two face plates and cross (slanted) plates, it has higher breaking-energy absorption property against compressive load (per unit planar area).

Though the hollow shape member 40B is positioned within the passenger room, but it is disposed at the end of the car body, so the influence to the passengers is considered to be small.

The ends of the center sills 36 and the side sills 31 can also be softened by heat treatment similar to the hollow shape member 40B. In such case, the end portion and the center portion of the member can either be formed of one member or be formed by welding plural parts together. If hollow shape members are used, the parts are fit to one another as explained earlier.

According to the above-mentioned embodiment, the structural bodies are formed of hollow shape members, but they can also be formed by thin plates and frame members.

The technical scope of the present invention is not limited to the terms used in the claims or in the summary of the present invention, but is extended for example to the range in which a person skilled in the art could easily substitute based on the present disclosure.

The present invention characterizes in that the members constituting both longitudinal ends of the car body of at least the underframe are formed of a material softer than the material of the members constituting the longitudinal center area of the car body, thus enabling to absorb the shock without having to add any special member to the inner portion or under the floor of the car body. The present invention enables to provide a car body with high safety that minimizes the impact force to the passengers and crew on the train when a sudden train crash occurs, without changing the car body structure greatly.

What is claimed is:

1. A railway car comprising an underframe, side structures, and a roof structure, wherein said underframe is composed of plural hollow shape members; and the direction of extrusion of said hollow shape members is disposed along the longitudinal direction of the railway car, and said plural hollow shape members are arranged along the circumferential direction of the railway car and welded to one another to form the railway car;

characterized in that said plural hollow shape members are formed so that material used to form both longitudinal ends of the railway car is softer than material used to form the longitudinal center portions thereof, the material used to form said both longitudinal ends being material formed by annealing.

2. A railway car according to claim 1, characterized in that each of said plural hollow shape members includes:

two first hollow shape members composed of the material for forming said both ends, formed as separate parts from a second hollow shape member composed of the material for forming said center portion, and the two first hollow shape members are respectively bonded to ends of the second hollow shape member.

3. A railway car according to claim 1, characterized in that the first hollow shape members composed of the material for forming said both ends and the second hollow shape member composed of the material for forming said center portion are formed as one hollow shape member.

4. A railway car according to claim 1, wherein side sills are disposed at both sides of said underframe and are selected such that material used to form both end areas thereof is softer than material used to form longitudinal center areas thereof.

5. A railway car according to claim 1, wherein one or more center sills are disposed on a lower side of said underframe along the longitudinal direction of the railway car for joining a coupler thereto and are selected such that material used to form said end areas thereof is softer than material used to form the longitudinal center areas thereof.

6. A railway car according to claim 1, wherein said side structures and said roof structure are composed of a plurality of second hollow shape members;

the direction of extrusion of said plurality of second hollow shape members is disposed along the longitudinal direction of the railway car, the plurality of second hollow shape members being arranged along the circumferential direction of the railway car and bonded to one another; and said plurality of second hollow shape members are formed so that material used to form both end areas thereof is softer than material used to form the longitudinal center areas thereof.

7. A railway car according to claim 6, wherein each of said plurality of second hollow shape members includes end portions and a center portion, the end portions forming the end areas and the center portion forming the longitudinal center area, of each second hollow shape member; and said end portions of each second hollow shape member and said center portion of said second hollow shape member are separate members, and said end portions are welded to respective ends of the center portion.

8. A railway car according to claim 6, characterized in that the second hollow shape members composed of the material for forming said both ends and the second hollow shape member composed of the material for forming said center portion are formed as one hollow shape member.

9. A railway car according to claim 1, wherein the material used in forming the longitudinal center portions and the longitudinal ends have a same composition, with the material of the longitudinal ends having been made softer by said annealing.

10. A railway car comprising an underframe, side structures, and a roof structure, wherein:

said underframe is composed of plural hollow shape members; and the direction of extrusion of said hollow shape members is disposed along the longitudinal direction of the railway car, and said plural hollow shape members are arranged along the circumferential direction of the railway car and welded to one another to form the railway car;

characterized in that said plural hollow shape members are formed so that material used to form both longitudinal ends of the railway car is softer than material used to form the longitudinal center portions thereof;

each of said plural hollow shape members including:

two first hollow shape members composed of the material for forming said both longitudinal ends, formed as separate parts from a second hollow shape member composed of the material for forming the longitudinal center portion, and the two first hollow shape members are respectively bonded to ends of the second hollow shape member, and wherein:

each of the first hollow shape members and the second hollow shape members includes two face plates and a connecting member extending between the two face plates;

of the first hollow shape members disposed at both ends of the railway car and the second hollow shape members disposed at the center portion thereof, two of the face plates constituting one of the first and second hollow shape members are abutted against two of the face plates constituting the other of the first and second hollow shape members, with their abutted areas being welded;

said one of the first and second hollow shape members has the longitudinal end portion of a connecting member, connecting said two face plates, that is protruded from end portions of said two face plates;

said other of the first and second hollow shape members has longitudinal end portions of said two face plates that are protruded from the end portion of the connecting member connecting said two face plates; and the connecting member of said one of the first and second hollow shape members is disposed between the two face plates of said other of the first and second hollow shape members.

11. A railway car comprising an underframe, side structures, and a roof structure, wherein:

said underframe is composed of plural hollow shape members; and the direction of extrusion of said hollow shape members is disposed along the longitudinal direction of the railway car, and said plural hollow shape members are arranged along the circumferential direction of the railway car and welded to one another to form the railway car, characterized in that said plural hollow shape members are formed so that material used to form both longitudinal ends of the railway car is softer than material used to form the longitudinal center portions thereof, wherein:

said side structures and said roof structure are composed of a plurality of second hollow shape members;

the direction of extrusion of said plurality of second hollow shape members is disposed along the longitudinal direction of the railway car, the plurality of second hollow shape members being arranged along the circumferential direction of the railway car and bonded to one another; and said plurality of second hollow shape members are formed so that the material used to form end areas thereof is softer than material used to form longitudinal center areas thereof, wherein:

each of said plurality of second hollow shape members includes end portions and a center portion, the end portions forming the end areas and the center portion forming the longitudinal center area, of each second hollow shape member; and said end portions of each second hollow shape member and said longitudinal center portion of said second hollow shape member are separate members, and said end portions are welded to respective ends of the center portion, and wherein:

each of the plural second hollow shape members includes two face plates and a connecting member connecting between the two face plates;

of the plural second hollow shape members disposed at both ends of the car body and the plural second hollow shape members disposed at the center portion thereof, the two face plates constituting one of the hollow shape members are abutted against the two face plates constituting another one of the hollow shape members, with their abutted areas being welded;

said one hollow shape member has the longitudinal end portion of a connecting member connecting said two face plates that is protruded from end portions of said two face plates;

said another hollow shape member has a longitudinal end portion of said two face plates that are protruded from the end portion of the connecting member connecting said two face plates; and the connecting member of said one hollow shape member is disposed between the two face plates of said another hollow shape member.

* * * * *